US006453011B1

(12) United States Patent
Lohmann et al.

(10) Patent No.: US 6,453,011 B1
(45) Date of Patent: Sep. 17, 2002

(54) X-RAY TUBE WITH ROTATING ANODE CORE

(75) Inventors: Lothar Lohmann, Rösrath; Hans Julicher, Köln, both of (DE)

(73) Assignee: Dr. Franz Lohmann, Inh. Hermann Lohmann, Leverkusen (DE)

( * ) Notice: Subject to any disclaimer, the term of this patent is extended or adjusted under 35 U.S.C. 154(b) by 0 days.

(21) Appl. No.: 09/727,309

(22) Filed: Nov. 30, 2000

(30) Foreign Application Priority Data

Dec. 2, 1999 (DE) ..... 199 58 115

(51) Int. Cl.[7] ..... H01J 5/18
(52) U.S. Cl. ..... 378/140; 378/130; 378/125
(58) Field of Search ..... 378/125, 130, 378/140

(56) References Cited

U.S. PATENT DOCUMENTS 2,496,112 A * 1/1950 Van Der Tuub ..... 378/125
4,309,637 A 1/1982 Fetter
5,535,255 A 7/1996 Gabbay

FOREIGN PATENT DOCUMENTS

DE 26 58513 A1 6/1978
DE 28 10 628 A1 9/1978

OTHER PUBLICATIONS varian X–ray Tube Products Type A145, Product Description, Rev. 1 08/97.
Lohmann X–ray Type 160/25 HA, 1946.

* cited by examiner

*Primary Examiner*—Craig E. Church
(74) *Attorney, Agent, or Firm*—Akin, Gump, Strauss, Hauer & Feld, L.L.P.

(57) ABSTRACT

Conventional x-ray tubes are designed as stationary or rotating-anode tubes. While the former are restricted in output, the latter are of complicated design. An x-ray tube is provided having an anode comprising a stationary shell and a rotating core mounted therein. Consequently, it is more compact than a rotating-anode tube and permits higher focal spot loads than a stationary-anode tube. The tube can be used for imaging procedures in medical diagnostics and in material testing.

14 Claims, 1 Drawing Sheet

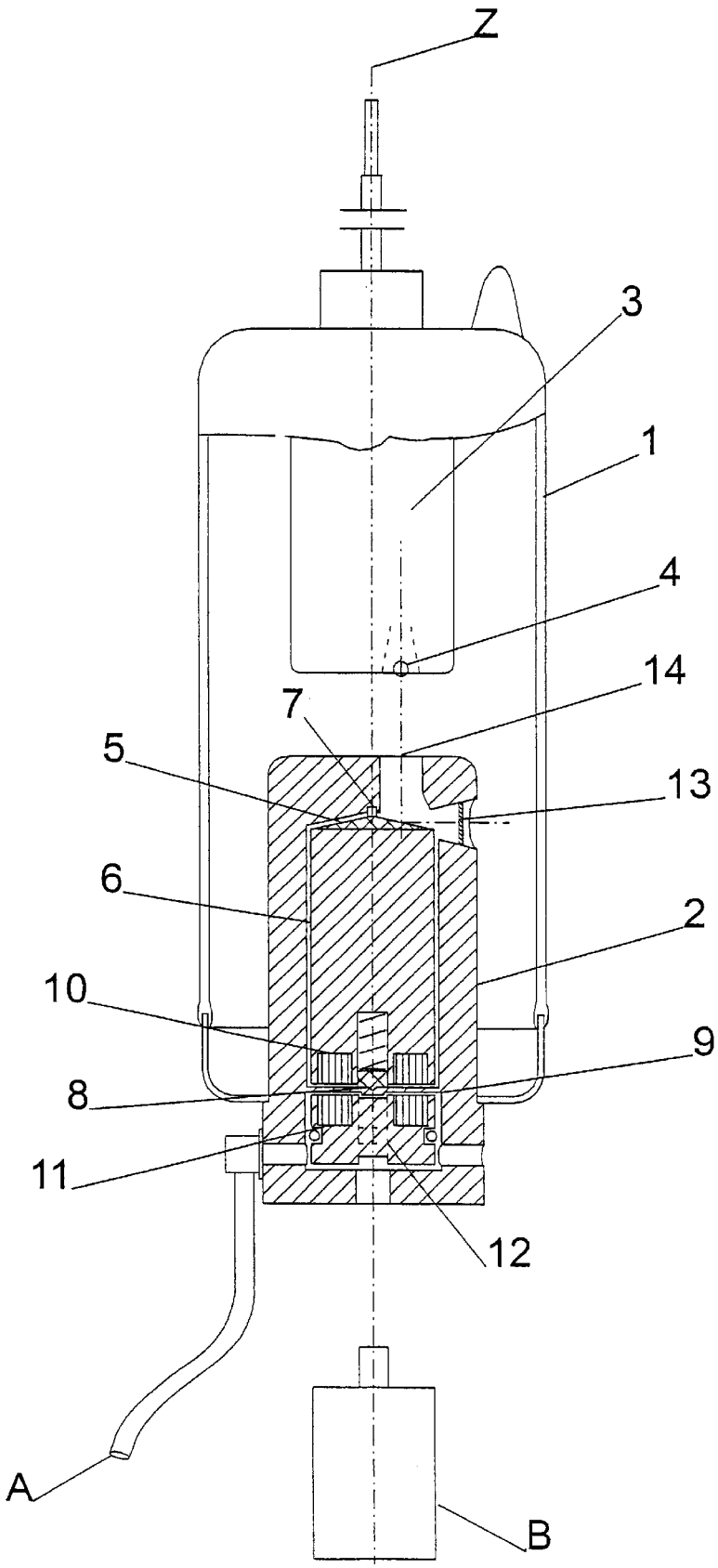
Z
3
1
4
14
7
5
13
6
2
10
9
8
11
12
A
B

X-RAY TUBE WITH ROTATING ANODE CORE

BACKGROUND OF THE INVENTION

The invention relates to an x-ray tube with a static cathode and a rotating anode core that preferably has a conical target and is located inside the stationary anode.

In stationary-anode x-ray tubes according to the prior art (e.g., LOHMANN Type 160/25 HA), the maximum achievable thermal load of the focal spot is limited by the target material. Particularly with small focal spots and high tube current, as is required for high-resolution imaging methods, the target material is eroded during operation, before effective cooling of the target is possible. As a result of the increasing erosion of the target material, the operating values of a conventional stationary-anode tube of this kind deteriorate, which can ultimately lead to its complete failure. Consequently, tubes of this kind are primarily used for low focal spot loads, when sensitive detectors are available or when long exposure times are acceptable.

By rotating the target under the static focal spot, this disadvantage is prevented in that the area subject to thermal load is enlarged in annular fashion. In rotating-anode x-ray tubes of this kind (e.g., VARIAN Type A145), an electron beam is focussed well outside the longitudinal axis of the tube on an anode disk of relatively large diameter. This known structural design is capable of realizing high currents with relatively small focal spots. The thermal load is compensated for by the thermal capacity of the anode disk when the tube is used in pulse operation. The relatively rapid rotation of the heavy anode disk necessitates a complex bearing mount and can still cause undesirable vibrations that impair the imaging quality. Moreover, it is difficult to cool the anode directly. Thus, rotating-anode x-ray tubes are relatively complex, large and expensive.

BRIEF SUMMARY OF THE INVENTION

An object of the invention is to design an x-ray tube which, while providing good imaging quality, permits a greater load on the focal spot compared to stationary-anode tubes and is also more compact, of simpler design and thus cheaper than rotating-anode tubes.

This object is solved by an x-ray tube according to the invention with a stationary cathode and an anode, wherein the anode comprises a stationary shell and an essentially cylindrical core pivot-mounted inside the shell that has a target on the end facing the cathode, and wherein the shell has openings outside the center axis on the end facing the cathode and on the side surface at the height of the target to allow passage of the accelerated electrons and the x-rays generated in the target. Preferred configurations are presented below and in the dependent claims.

The shell can essentially be designed as a hollow cylinder and encloses the likewise essentially cylindrical core. The end of the shell facing the cathode is provided with an opening outside the longitudinal axis of this arrangement, which permits the electrons emitted by the cathode and accelerated by the electric field to pass through to the core. However, the interior of the shell and the core can also be of other shapes that match one another and permit rotation of the core, such as nesting, truncated cones.

The side surface of the shell has another opening at the height of the target, which permits the x-rays generated in the target to pass to the outside.

The preferred materials for the shell are heavy metals, such as copper and tungsten, as well as alloys and composite materials made of these metals (copper for the core and tungsten and tungsten-rhenium for the target).

In a preferred configuration, the anode core is mounted only at the two ends. Furthermore, the bearings are preferably mounted in the center axis and designed as toe bearings. In this context, one toe rests on a preferably concave surface. The material of the toe and the surface can be the same or different and preferably has a medium to high hardness. Suitable materials are, for example, steel, diamond, ceramics, tungsten.

The target mounted on the end of the core facing the cathode is advantageously in the shape of a cone, which preferably has an aperture angle of 0 to 45 degrees. In this case, the toe bearing can be mounted on the cone tip. The target can also be in the form of a flat, truncated cone or a disk.

The anode is preferably designed such that it is possible for the core to achieve rotational speeds of between 1 and 1000 rpm.

The gap between the inside surface of the shell and the core is preferably no more than 1 mm, a gap of 0.1 to 0.5 mm being particularly preferable.

As the interior of the shell is connected to the tube vacuum, it must be sealed off from the atmosphere. This is achieved by means of a wall, preferably made of vacuum-tight, non-magnetic material, such as copper, stainless steel or beryllium. The wall can be connected to the shell by known methods, such as soldering or welding.

Means for driving the pivot-mounted core inside the tube can be provided outside the interior of the tube, preferably on the atmosphere side of this wall. These means can be a moving magnetic field, if the core is magnetic or magnetizable. A moving magnetic field can be generated by one or more rotating magnets. The magnet can at least partially be designed as an impeller, or built into one, and be located in a cavity through which a fluid (e.g., oil, air, water) flows, so that it is driven by this flow. Another preferred drive is a motor, e.g. an electric motor.

For example, two inserts that are preferably made of iron can be built into the end of the rotating core and a pair of magnets into an impeller, which is separated from the vacuum space by a thin metal wall and guided in its own, small chamber that is open towards the generator housing. For the oil-flow drive, insulating oil is pumped from the generator housing via a hose connection into this chamber outside the vacuum space, thus driving the impeller. This causes the inside anode core to rotate and, at the same time, heat from the end of the anode is transported with the oil flow.

A fluid, preferably oil, can also flow through the shell for cooling, and the shell can be provided with suitable bore holes and hoses for this purpose.

The shell enclosing the rotating core also acts as an anode housing with window for improving smooth electrical running. In this case, it is preferably made of heavy metal, in order to avoid undesirable back reflection. In addition, the window only permits radiation to emerge in the desired direction and thus serves the purpose of radiation protection. A special anode housing, such as described for a rotating-anode tube in U.S. Pat. No. 4,309,637, is not necessary.

This arrangement permits very precise guidance of the target and, ultimately, sharply defined focal spot imaging.

Another advantage of arranging the rotating core inside the shell is the possibility of conducting heat out of the core and into the shell by means of thermal radiation. This is made possible by a narrow gap between the core and the shell and can also be further promoted by dulling, blackening or roughening the opposing surfaces. The shell itself can be cooled simply and directly using a fluid, preferably oil.

Furthermore, this arrangement permits simple magnetic coupling of the rotating anode core with magnets installed outside the vacuum space, these in turn being easily driven by an electric motor or an oil flow, for example. For this purpose, two inserts that are preferably made of iron are built into the end of the rotating core and one or more magnets into an impeller, for example, which is separated from the vacuum space by a thin metal wall and guided in its own, small chamber that is open towards the generator housing.

Overall, the strictly axial arrangement of the anode core with anode housing and the 2-toe bearing, that is possible as a result, ensure a slim and inexpensive design.

The tube according to the invention can be installed in a high-voltage generator without requiring a separate tube housing. It can be used for imaging procedures, e.g., in medical diagnostics and material testing.

BRIEF DESCRIPTION OF THE SEVERAL VIEWS OF THE DRAWING

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

The sole FIGURE of drawings is a schematic illustration of an exemplary x-ray tube according to the invention, partially broken-away and partially in section.

DETAILED DESCRIPTION OF THE INVENTION

In a vacuum housing 1 (made of glass in this case), anode 2 and cathode 3 are firmly connected to the housing along center axis Z in rotationally symmetrical fashion. Heater coil(s) 4 is/are located in the cathode at a small distance from center axis Z, in order to emit the electrons to be accelerated by the high applied voltage. The electrons pass through opening 14 in the inside of the shell. The bremsstrahlung develops on the preferably conical, highly heat-resistant surface of tungsten target 5 on anode core 6. Anode core 6 is precisely pivot-mounted on center axis Z by upper 7 and lower 8, additionally pre-tensioned, toe bearings. The bearings consist of tungsten toes that rest on concave ceramic surfaces. The lower thrust bearing rests on a thin wall 9 made of beryllium, which seals off the vacuum space and simultaneously allows magnetic coupling forces 10 to pass. Lower fixed magnet pair 11 rests in a separately bearing-mounted impeller 12, which can be driven, for example, by either an oil flow A or an electric motor B. As a result of this design, this area of the device functions as a cooler.

During operation, anode core 6 is caused to rotate about center axis Z. As the axial length of the core is greater than its diameter, any imbalance that may occur is slight. The bremsstrahlung energy that develops on target 5 leaves anode 2 through anode window 13 as x-ray radiation. In this context, anode shell 2 holds back undesired radiation and free, electrically charged particles. The majority of the energy remains in target 5 in the form of heat and is further conducted to anode core 6 and distributed. The energy is further conducted to shell 2 by thermal radiation and directly dissipated into the medium (preferably oil) surrounding the tube by heat exchange.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An X-ray tube comprising a stationary cathode (3) and an anode, wherein the anode comprises a stationary shell (2) and a cylindrical core (6), the cylindrical core (6) defining an interior which is solid substantially through-out, said cylindrical core being rotatably-mounted inside the shell having a target (5) on an end facing the cathode, and wherein the shell has openings (14, 13) outside a center axis on the end facing the cathode and on a side surface at a height of the target to allow passage of accelerated electrons and x-rays generated in the target, said cylindrical core being rotatably driven by a drive mechanism.

2. The X-ray tube according to claim 1, wherein the core (6) is mounted only at two ends in bearings (7,8).

3. The X-ray tube according to claim 2, wherein the bearings (7,8) are located along the center axis.

4. The X-ray tube according to claim 3, wherein the bearings (7,8) are toe bearings.

5. The X-ray tube according to claim 1, wherein the target (5) has a shape of a cone, a truncated cone or a disk.

6. The X-ray tube according to claim 1, wherein a gap between the core and an inside surface of the shell is no more than 1 mm wide.

7. The X-ray tube according to claim 1, wherein an interior of the tube is sealed off by a wall (9) inside the shell (2).

8. The x-ray tube according to claim 7, wherein the drive mechanism is located exterior of the tube.

9. The X-ray tube according to claim 8, wherein the drive mechanism is a moving magnetic field (10,11).

10. The X-ray tube according to claim 9, wherein the moving magnetic field is generated by at least one rotating magnets.

11. The X-ray tube according to claim 10, wherein the at least one rotating magnet is shaped such that it can be driven by flowing cooling fluid.

12. The X-ray tube according to claim 11, wherein the magnet is at least partially designed as an impeller or built into one.

13. The X-ray tube according to claim 10, wherein the tube includes a motor for driving the at least one magnet.

14. The X-ray tube according to claim 1, wherein the shell (2) has bore holes and hoses A for conducting a cooling fluid.

* * * * *